US005179809A

United States Patent [19]

Schroeder

[11] Patent Number: 5,179,809

[45] Date of Patent: Jan. 19, 1993

[54] DRILL GRINDING MACHINE

[75] Inventor: Richard L. Schroeder, North Fond du Lac, Wis.

[73] Assignee: Giddings & Lewis, Inc., Fond du Lac, Wis.

[21] Appl. No.: 865,555

[22] Filed: Apr. 8, 1992

Related U.S. Application Data

[62] Division of Ser. No. 513,080, Apr. 23, 1990, Pat. No. 5,125,186.

[51] Int. Cl.[5] ..... B24B 3/00

[52] U.S. Cl. ..... 51/288

[58] Field of Search ..... 51/288, 94 R, 94 CS, 51/95 R, 95 LH, 219 R

[56] References Cited

U.S. PATENT DOCUMENTS

| | | | |
|---|---|---|---|
| 3,040,480 | 6/1962 | Winslow et al. | 51/94 R |
| 3,067,548 | 12/1962 | Winslow | 51/94 R |
| 3,266,194 | 8/1966 | Winslow | 51/94 R |

*Primary Examiner*—M. Rachuba

*Attorney, Agent, or Firm*—Donald Cayen

[57] ABSTRACT

A drill grinding machine employs independent servo motors for drill rotation, drill lift, and drill feed. The three motors are connected through respective suitable drive mechanisms to a tubular spindle that is rotatably mounted within a work head. The work head contains a hydraulic clamp for selectively chucking and releasing a drill holder. A drill is gripped in the drill holder such that the drill point is proximate a grinding wheel. The drill, lift, and feed motors are actuated to rotate the drill about its longitudinal axis and to move the drill point along a predetermined cyclical path of contact with the grinding wheel to grind a selected point. Combinations of points may be ground on a single drill by suitably controlling the lift and feed motors. A timing pad adjustably mounted to the machine housing cooperates with the lift and feed motors and the work head clamp to enable the drill to be manually timed prior to a grinding cycle. Drill rock is selectively available through spring loaded contact between the work head and a hardened strip that is rotatably mounted in the machine housing.

5 Claims, 15 Drawing Sheets

DRILL GRINDING MACHINE

This is a divisional of co-pending application Ser. No. 513,080 filed on Apr. 23, 1990 now U.S. Pat. No. 5,125,186.

BACKGROUND OF THE INVENTION

1. Field of the Invention

This invention pertains to machine tools, and more particularly to apparatus for machining drill points.

2. Description of the Prior Art

Twist drills having different types of cutting points are well known. Drill points commonly used in industrial applications include conventional, helical, Racon, split, and Bickford points. The different points are designed to achieve maximum cutting rates in a variety of workpiece materials and configurations.

Before starting the drill pointing process, the drill is positioned to a known orientation with respect to a grinding wheel. Initially positioning the drill is commonly referred to as timing the drill. In some prior machines, the drill is gripped within a holder, and the holder and drill are positioned as a unit to time the drill. If the drill is gripped within a holder, means is usually provided with the machine for selectively releasing the drill from the holder. In other machines, the drill is gripped directly, and timing involves positioning only the drill relative to the grinding wheel.

Machine grinding of the various twist drill points requires complex three-dimensional relative motion between the drill and the grinding wheel. Normally, the grinding wheel rotates about a generally stationary axis, and the drill is cyclically fed against the wheel while the drill undergoes at least three components of motion during each cycle. The first component of motion is a constant velocity rotation of the drill about its longitudinal axis The second motion is a linear reciprocation of the drill in directions perpendicular to the drill longitudinal axis. That motion is commonly called the lift motion. The third motion is movements of the drill nominally along its longitudinal axis. That motion is known as the feed motion.

Lift and feed motions occur in timed relation to the rotation of the drill. Lift and feed motions also occur in cycles that correspond to the number of cutting edges on the drill point, with a cycle being repeated for each cutting edge during one revolution of the drill. Although the drill rotates about its longitudinal axis at a constant angular velocity, neither the lift nor the feed motions need be of constant velocity.

For some types of drill points, a fourth motion of the drill is required. The fourth motion is a rotation of the drill about an axis that is perpendicular to but that does not intersect the drill longitudinal axis. That motion is frequently referred to as a rock motion. Like the lift and feed motions, the rock motion is cyclically repeated for each cutting edge during a drill revolution about its longitudinal axis.

In some prior drill grinding machines, the lift, feed, and rock motions are imparted to the drill being ground by a series of cams, cam followers, links, and levers. The cams are rotated at a constant speed. The links and levers convert cam rotational motion into the appropriate lift, feed, and rock motions at the drill point. Different cams are used for different types of drill points and for different drill diameters. In addition, many of the various components, such as the links and levers, are adjustable to suit different drill points and diameters. Examples of prior drill grinding machines constructed generally according to the foregoing description may be seen in U.S. Pat. No. 4,365,444 and in the references cited therein. Additional examples of prior drill grinding machines are described in U.S. Pat. Nos. 3,067,548 and 3,656,264. Other commercial equipment for grinding drill points is marketed under the trademarks Winslow, Winslowmatic, and Bickford Point.

The drill grinding machine of U.S. Pat. No. 4,365,444, as well as other commercially available equipment, has enjoyed widespread acceptance. However, the cams, links, and other mechanical drive trains of the prior machines are undesirably expensive to manufacture and assemble. In addition, the prior drive mechanisms must frequently be adjusted to suit the type of point to be ground or the drill size, which results in downtime and decreased productivity.

Consequently, there is room for improvement in the design and operation of drill pointing machines.

SUMMARY OF THE INVENTION

In accordance with the present invention, a drill grinding machine is provided that is capable of generating twist drill points in a more efficient and economical manner than was previously possible. This is accomplished by apparatus that includes separate and independent prime movers for each of three motions imparted to the drill relative to a grinding wheel during the pointing process.

The grinding wheel is mounted in the machine housing for rotation about a generally fixed axis. The first motion of the drill is a rotation about its longitudinal axis. The drill longitudinal axis is generally perpendicular to the axis of the grinding wheel. Rotation of the drill about its longitudinal axis is achieved by a first electric motor, called a drill motor. The drill motor is mounted to a bearing block. Rotatably mounted within the bearing block is one end of an elongated post. The post second end is guided for reciprocation by bearings mounted in the machine housing. The longitudinal axes of the bearing block, post, and drill motor are concentric, and they define a lift axis that is parallel to the grinding wheel axis.

A work head is mounted to the second end of the post. A spindle rotatably mounted within the work head has an axis that is perpendicular to the lift axis. The spindle receives a drill holder, in which the drill is gripped, such that the drill point is proximate the grinding wheel. The drill motor rotates the spindle within the work head by means of a drive shaft extending through the post and bearing block. Actuating the drill motor at a constant speed thus drives the spindle and drill at a proportional constant speed. Since the angular position of the drill is important for properly grinding the point, the drill motor is preferably a servo motor or an AC motor with resolver feedback.

To chuck the drill holder in the spindle, the present invention includes a hydraulically actuated clamp incorporated into the work head and spindle. Applying hydraulic pressure to the work head clamp causes a pair of cams to radially press against the drill holder periphery and rigidly chuck the drill holder in the spindle. The drill is gripped in the drill holder by a spring loaded collet chuck. Releasing the spring force within the collet chuck allows the drill to be inserted into and removed from the collet chuck.

The second motion of the drill is a lift motion in which the work head and drill reciprocate along the lift axis in directions perpendicular to the longitudinal axis of the drill and parallel to the axis of the grinding wheel. Lift motion is provided by a lift motor, which may be a servo motor, that oscillates in timed relation to the rotation of the spindle and drill. The lift motor is mounted to the machine housing. The lift motor is coupled to a first shaft rotatably mounted to the housing. One or more timing pulleys are attached to the first shaft. A second shaft with timing pulleys is also rotatably mounted to the housing. Timing belts are trained around associated pulleys on the first and second shafts. An idler pulley for each timing belt adjusts belt tension.

Gripping each belt is a lift clamp. In the preferred embodiment, each lift clamp comprises a bracket having one end secured to the bearing block to which the drill motor is mounted. The timing belt is sandwiched between the bracket second end and a cap having teeth that mesh with the timing belt teeth. By oscillating the lift motor, the brackets and thus the bearing block, together with the drill motor, post, and work head, reciprocate along the lift axis in unison with the oscillation of the lift motor.

Also mounted to the bearing block is a feed motor. The output shaft of the feed motor is preferably parallel to the lift axis, which is the common longitudinal axes of the bearing block, post, and drive shaft. A pulley is attached to the feed motor output shaft, and a similar pulley is attached to the post. A timing belt is trained over those two pulleys. Oscillation of the feed motor causes a similar oscillation of the post about the lift axis. Oscillation of the post causes identical oscillation of the work head and of the drill in the spindle. Work head and drill oscillation about the lift axis is commonly called the feed motion.

The drill, lift, and feed motors may be controlled by a suitable programmable controller to operate in a fashion that imparts desired lift and feed motions to the work head in timed relation to the rotation of the spindle and the drill chucked therein. The lift and feed motors oscillate in correlation with the steady state rotation of the drill motor such that a lift and feed cycle is performed for each cutting edge of a drill during a complete revolution of the drill.

To remove material from the drill point, the point is fed against the grinding wheel as the drill undergoes a cycle of the three components of motion. It is preferred that the grinding wheel is advanceable relative to the drill point by a grinding wheel motor, which may be a servo motor, acting through a linear motion device, such as a screw and nut arrangement. The grinding wheel servo motor is controlled in timed relation with the other servo motors so that the grinding wheel cuts the proper amount of material from the drill point during each revolution of the drill.

Some types of drill points require that the drill undergo a fourth motion, called a rock motion, during the grinding process. Rock motion is defined as rotation of the drill about a rock axis that is perpendicular to and spaced from the drill longitudinal axis and that is also perpendicular to the lift axis. To provide the rock axis, the work head is joined to the second end of the post by a bracket. Suitable bearings are used to rotatably mount the work head to the bracket; the bearings define the rock axis. Rock motion is achieved through a hardened pin on the work head that is capable of riding on a hardened strip fixed to the machine housing. A strong spring acting between the machine housing and the work head biases the work head pin against the strip. As the work head undergoes lift and feed motion from the lift and feed motors, respectively, the pin bears against and rides along the strip. Feed motion of the work head about the lift axis causes the work head to simultaneously oscillate about the rock axis. Rock motion occurs as the bracket and the portion of the work head mounted therein rotate in the feed motion toward the machine housing, while the pin, which is contact with the strip, prevents the portion of the work head adjacent thereto from oscillating with the bracket and the rock axis bearings. As a result, the work head and drill tilt about the rock axis simultaneously with their feed motion rotation about the lift axis toward the grinding wheel, and the drill longitudinal axis tilts to an acute angle relative to the grinding wheel axis. On the reverse stroke of the feed cycle, the spring between the work head and the machine housing causes the pin and strip to maintain contact and allow the work head and drill to tilt back such that the drill longitudinal axis again becomes perpendicular to the grinding wheel axis. The drill thus undergoes motion in all three angular degrees of freedom when the rock motion is present.

If the rock motion is not required, the work head is locked to the bracket such that the work head pin is out of contact with the strip on the housing. In addition, the strip can be temporarily removed from the vicinity of the pin. In that situation, there is no relative tilting between the work head and grinding wheel during a grinding cycle, and the rock motion is eliminated.

The drill grinding machine of the present invention includes a timing device that axially and rotationally orients the drill at the beginning of a grinding operation. The timing device may be in the form of a hardened pad fixed to the machine housing. The pad has a flat locating surface located at a known position relative to the machine housing. With the work head clamp released, the drill holder with the drill gripped therein is inserted into the spindle. The drill holder is rotated and advanced manually within the spindle until a drill cutting edge abuts the timing pad locating surface. When that occurs, the drill is properly oriented. The work head clamp is then actuated to chuck the drill holder in the spindle, and the grinding cycle can begin.

The grinding wheel preferably includes a dresser. The dresser may be manually operated, or it may be operated under the control of the programmable controller.

Other advantages, benefits, and features of the present invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
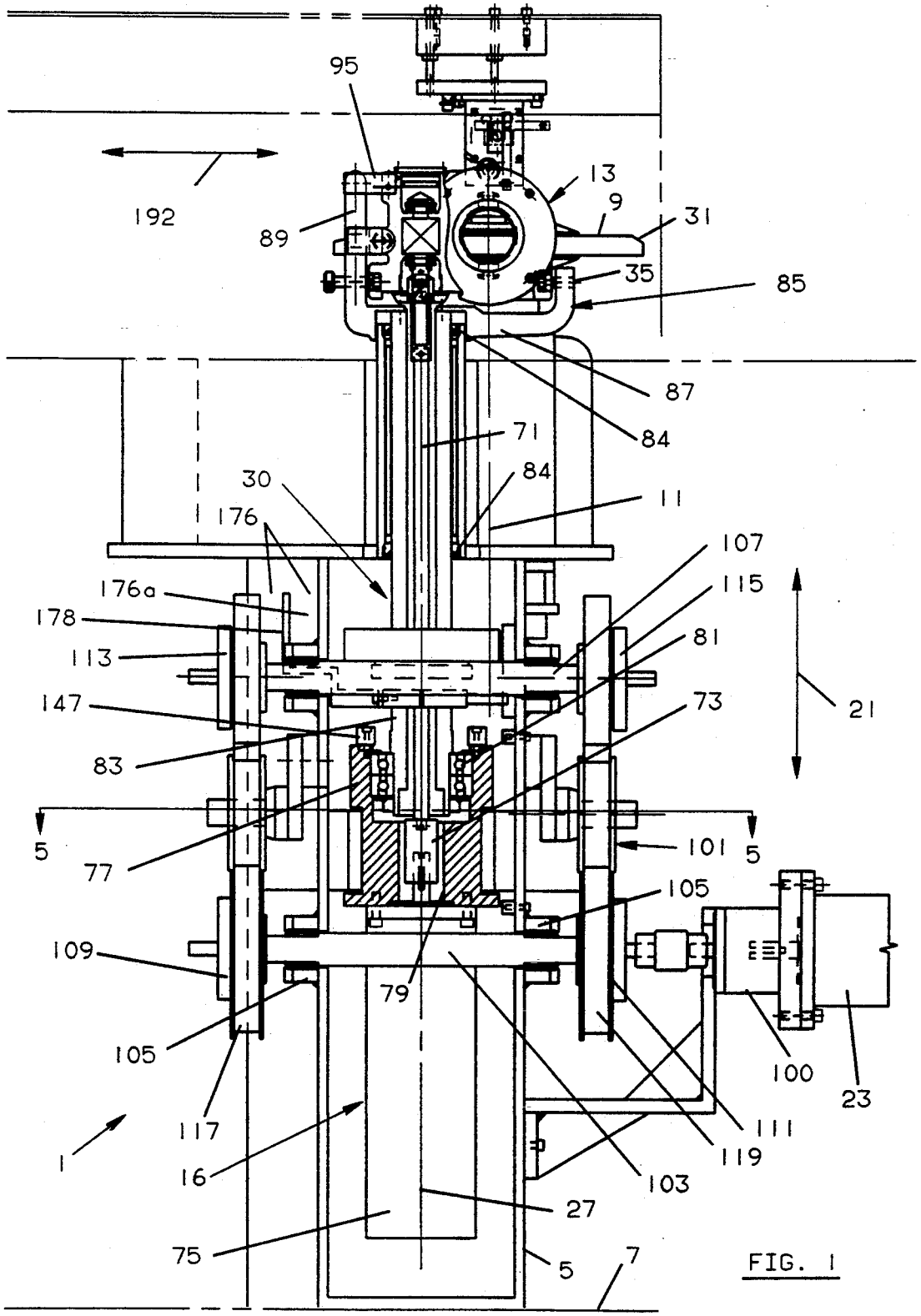
FIG. 1 is a partially broken front view of a portion of the drill grinding machine of the present invention.
Figure 2:
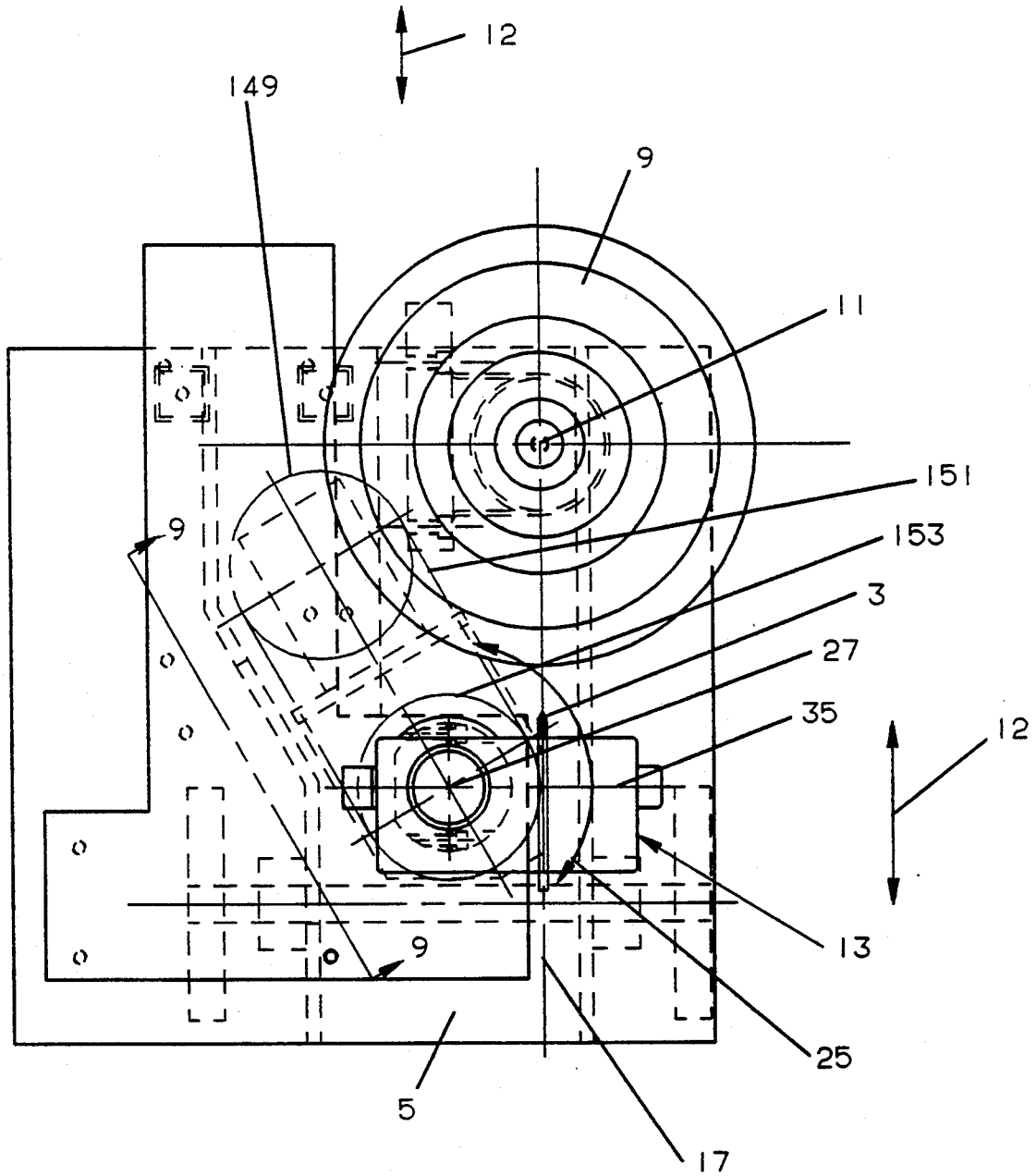
FIG. 2 is a top view on an enlarged scale of FIG. 1.
Figure 3:
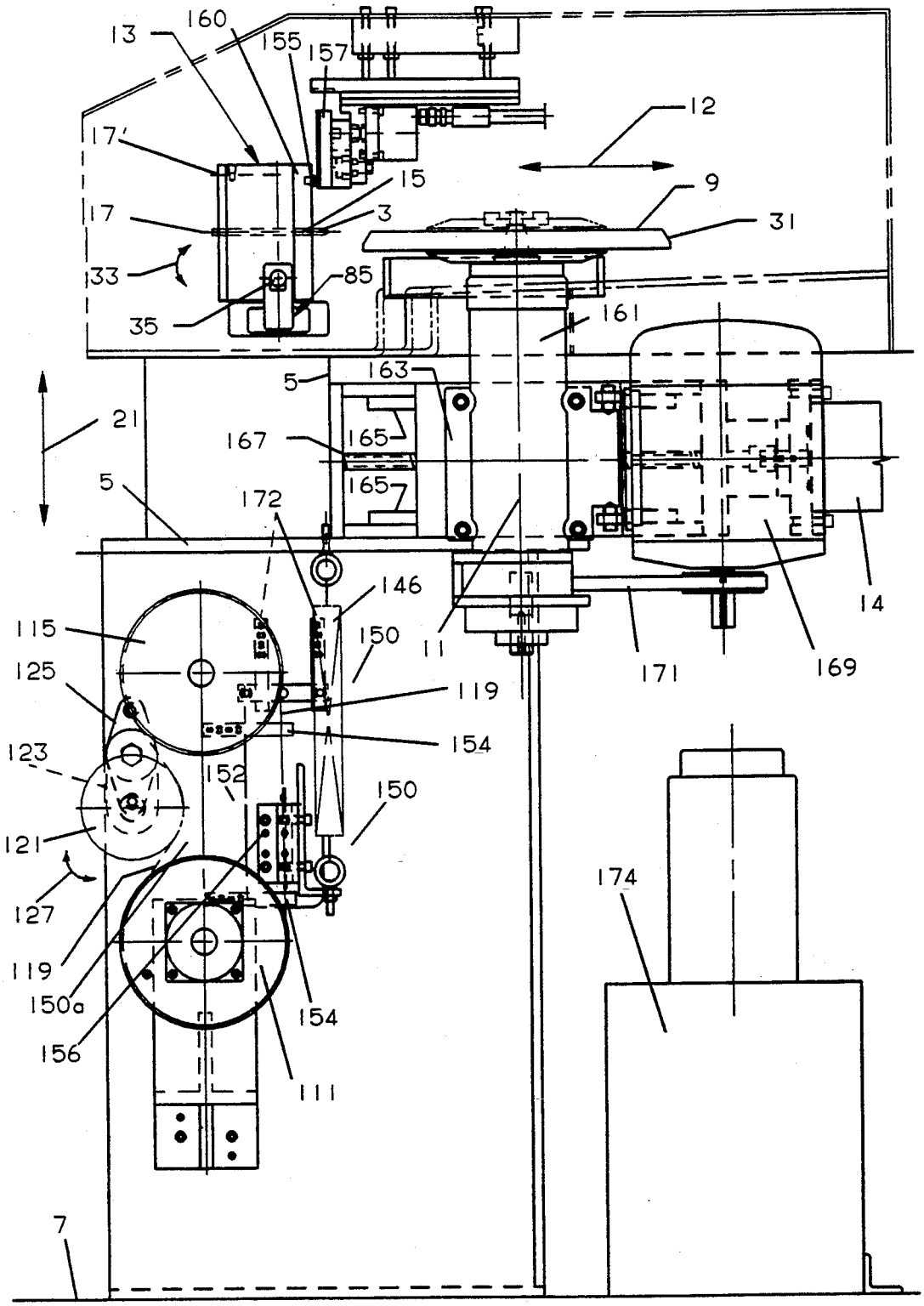
FIG. 3 is a side view of FIG. 1.

Referring to FIGS. 1-3, a drill grinding machine 1 is illustrated that includes the present invention. The drill grinding machine is particularly useful for grinding cutting points on twist drills, such as is typically represented at reference numeral 3.

GENERAL

The drill grinding machine 1 comprises a sturdy housing 5 that is supported on a floor 7. The housing 5 supports a grinding wheel 9 that rotates about a vertical axis 11. The grinding wheel 9 is translatable in horizontal directions indicated by arrow 12 by an actuator 14.

Figure 11:
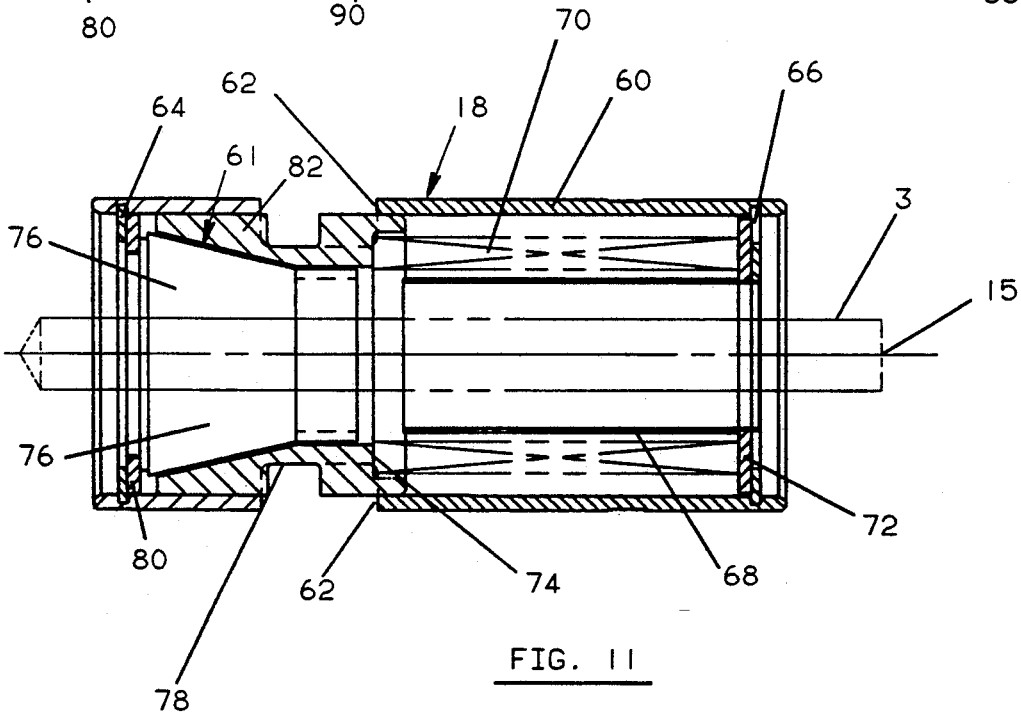
FIG. 11 is a longitudinal cross sectional view of the drill holder according to the present invention.

The drill 3 to be ground is gripped in a drill holder 18, FIG. 11. In turn, the drill holder 18 is chucked in a work head 13, with the drill longitudinal axis 15 normally horizontal. As the grinding wheel 9 rotates about axis 11, the drill is rotated about its longitudinal axis 15 within the work head 13. Drill rotation is produced by a drill rotation mechanism 16, which includes a drill motor 75.

Simultaneously with drill rotation, the work head 13 and drill 3 undergo at least two other motions. The work head and drill reciprocate vertically in the directions of arrow 21 under the impetus of a lift motor 23 acting through a drill lift mechanism 101. At the same time, the work head and drill oscillate in the directions of arrow 25 about a vertical lift axis 27. Oscillation of the work head and drill about the lift axis 27 is achieved by a feed motor 29 acting through a drill feed mechanism 30, FIG. 9. Actuation of the feed motor 29 causes the drill to be fed in an arcuate path in the directions of arrow 25 toward and away from the periphery 31 of the grinding wheel 9. Operation of the actuator 14 positions the grinding wheel at the proper spacing from the lift axis 27 for removing the desired amount of material from the drill point. For clarity, the grinding wheel is shown at a location that is much farther from the drill point than is actually the case during machining operations.

The operation of the lift motor 23 and feed motor 29 are in timed relation to the rotation of the drill 3 within the work head 13 to properly complete a grinding cycle for each cutting edge of the drill during a single revolution of the drill. The grinding cycles and drill revolutions are repeated as often as necessary to obtain the proper drill point. After each drill revolution, the grinding wheel 9 may be advanced a slight amount by the actuator 14 to compensate for wheel wear undergo a fourth motion during a grinding cycle. The fourth motion is a tilting of the work head in the directions of arrow 33 about a horizontal rock axis 35.

DRILL HOLDER

Turning to FIG. 11, the drill holder 18 is composed of a thin-walled sleeve 60 having a pair of diametrically opposed openings 62. A first snap ring 64 together with a spacer 80 at one end of the sleeve 60 locates one end of a collet chuck 61. The collet chuck 61 may be a commercially available item, such as is manufactured by Pratt Burnerd Company. A second snap ring 66 at the other end of the sleeve locates a flanged hub 68. A strong compression spring 70 acts between the flange 72 of the hub 68 and a step 74 in a slider 82. The spring 70 biases the slider 82 against tapered plates 76 in the collet chuck to tightly grip the drill 3. The slider has an external circumferential groove 78 that is longitudinally aligned with the sleeve openings 62. By forcing the slider to the right with respect to FIG. 11 against the spring 70 by means of the groove 78, the collet chuck plates 76 relax. In that situation, the drill can be inserted into or removed from the drill holder. Forcing the slider within the sleeve may be achieved with a known lever device located on the drill grinding machine and not illustrated herein.

The plates 76 of a particular collet chuck 61 can accommodate only a rather narrow range of drill sizes. Accordingly, different drill holders 18 having collet chucks with different sized plates are employed to suit different diameter drills 3. A set of several drill holders with a range of collet chuck sizes is usually included with the grinding machine 1. The other components of the various drill holders, including the sleeves 60, are identical. With a drill gripped in the drill holder, the drill holder may be inserted into the work head 13.

Figure 12:
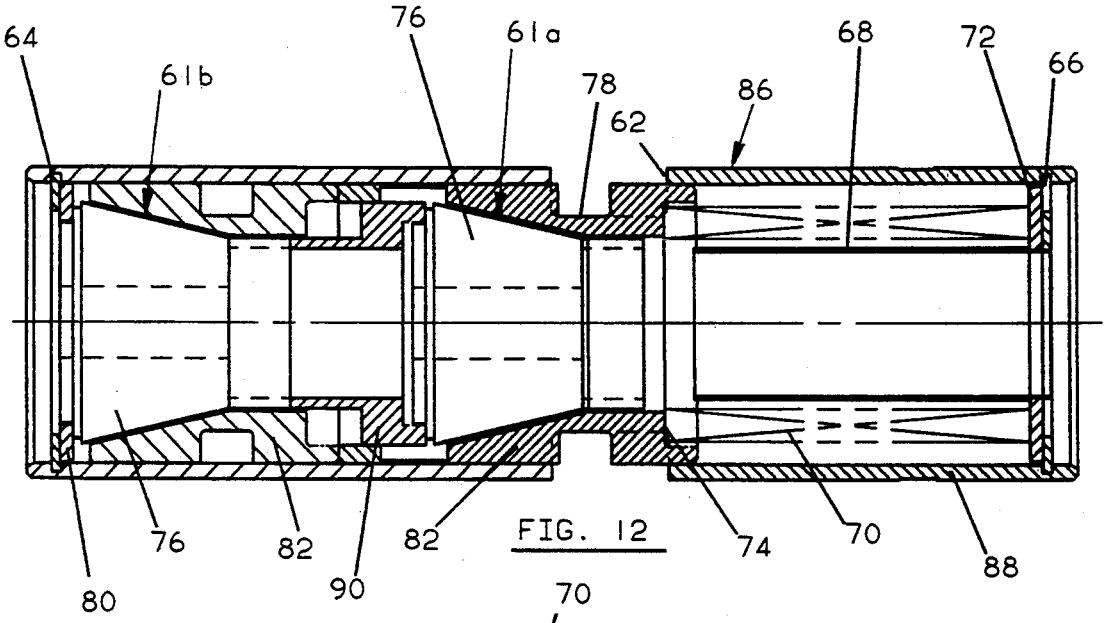
FIG. 12 is a view similar to FIG. 11, but showing a modified embodiment of the drill holder according to the present invention.

FIG. 12 shows a drill holder 86 that is used with drills having very shallow flute angles. The drill holder 86 is generally similar to the drill holder 18 described previously in connection with FIG. 11. However, the drill holder 86 has two collet chucks 61*a* and 61*b* enclosed in an elongated sleeve 88 and two sliders 82. A sliding spacer 90 transmits force from the spring 70 and collet chuck 61*a* to the collet chuck 61*b*. The remaining structural components and the function and operation of the drill holder 86 are substantially similar to that of the drill holder 18.

WORK HEAD

Looking also at FIGS. 4 and 8, the work head 13 will be described. The work head comprises a housing 37 and an end plate 39. The housing 37 and end plate 39 rotatingly receive a tubular spindle 41 by means of bearings 43 and 45. The spindle 41 has at least one and preferably a pair of openings 46 extending radially therethrough. The spindle bore 48 is sized to snugqly receive a tool holder 18. A chucking cam 47 is inserted through each spindle radial opening 46. The inner surface of each chucking cam 47 is formed with a cylindrical surface 49 of generally the same diameter as the bore 48 of the spindle 41. The outer surface of each chucking cam 47 has an angled surface 51. An annular cam ring 53 fits over the angled surfaces 51 of both chucking cams.

Mounted in the end plate 39 is an annular piston 55. The end plate and piston 55 cooperate to form a chamber 57. Hydraulic fluid is supplied to the chamber 57 by a hydraulic line, not illustrated, through port 59. Under the influence of the hydraulic fluid in the chamber 57, the piston forces the bearing 43 against the ring 53. In turn, the ring bears against the angled surfaces 51 of the cams 47 to force the cams radially inwardly toward the spindle axis 17. Accordingly, when the cams 47 are actuated by the hydraulic fluid in the chamber 57, they radially press against the sleeve 60 of the selected drill holder 18 inserted into the spindle bore 48. In that manner, the drill holder is firmly chucked in the spindle and thus also in the work head 13.

The work head housing 37 is rotatingly supported on a bracket 85 by means of pins and bearings 93. The bracket 85 may be generally U-shaped, having a base 87 and two spaced upright legs 89 and 91. The pins and bearings 93 define the rock axis 35 which is perpendicular to the spindle axis 17 and intersects the lift axis 27. The work head housing 37 and spindle 41 may be prevented from tilting about the rock axis 35. Tilting in one direction is prevented by a stop plate 95 that is pivotally connected by a screw 96 to the work head housing. In an operative position as shown in FIGS. 1 and 4, the stop plate 95 is pivoted about screw 96 to contact the leg 89 of the bracket 85, thus preventing the work head housing from tilting clockwise with respect to FIG. 3.

Tilting in the counterclockwise direction with respect to FIG. 3 is prevented by a strong spring 97 that is interposed between the work head housing 37 and an arm 99 affixed to the bracket leg 89. The spring 97 biases the work head housing in the clockwise direction with respect to FIG. 3. Since clockwise tilting is prevented by the plate 95 bearing against the bracket leg 89, the work head housing is maintained at an equilibrium position whereat the spindle axis 17 remains horizontal.

DRILL ROTATION

Figure 4:
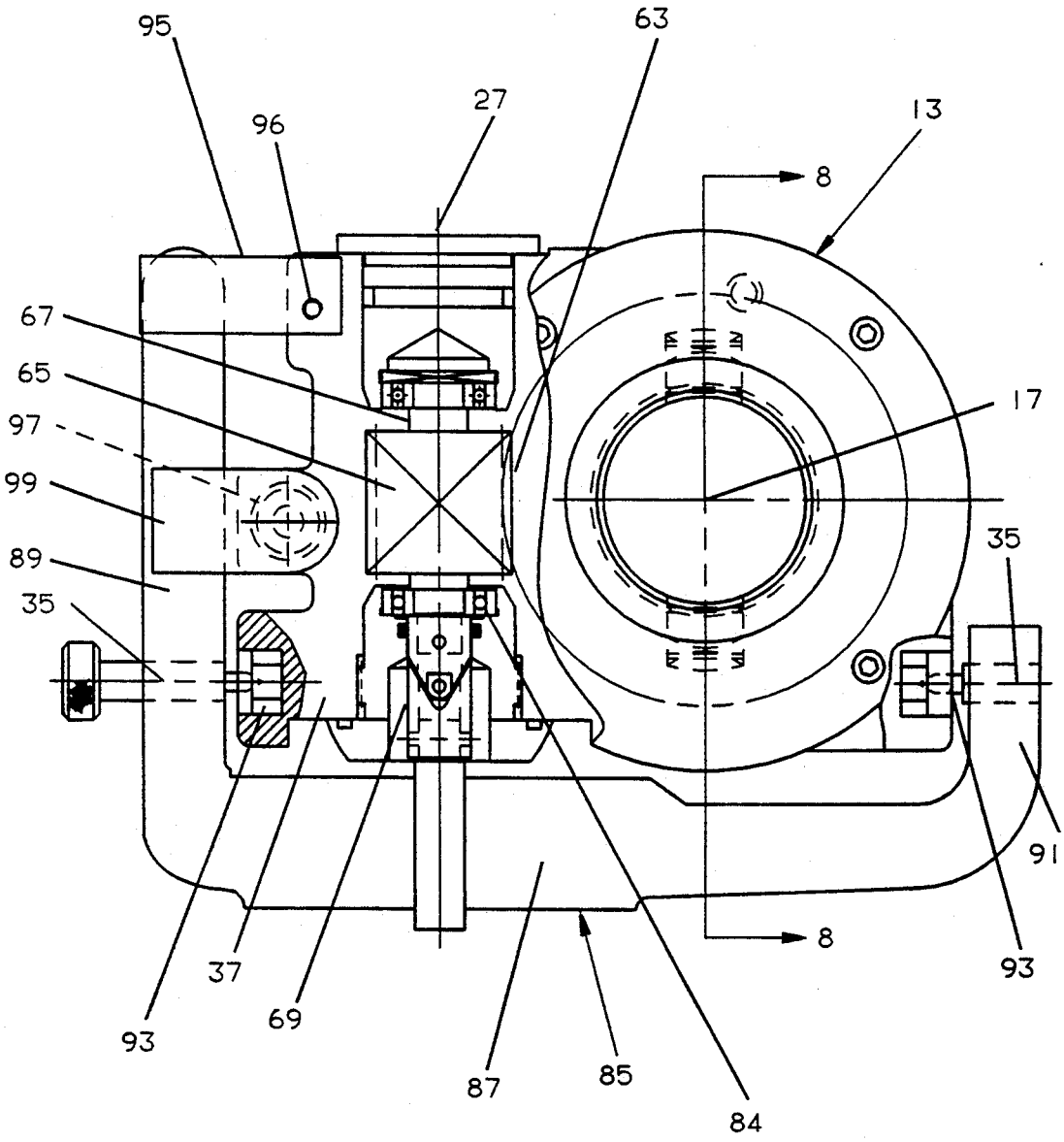
FIG. 4 is an enlarged partially broken front view of a portion of the work head and spindle rotation mechanism.
Figure 8:
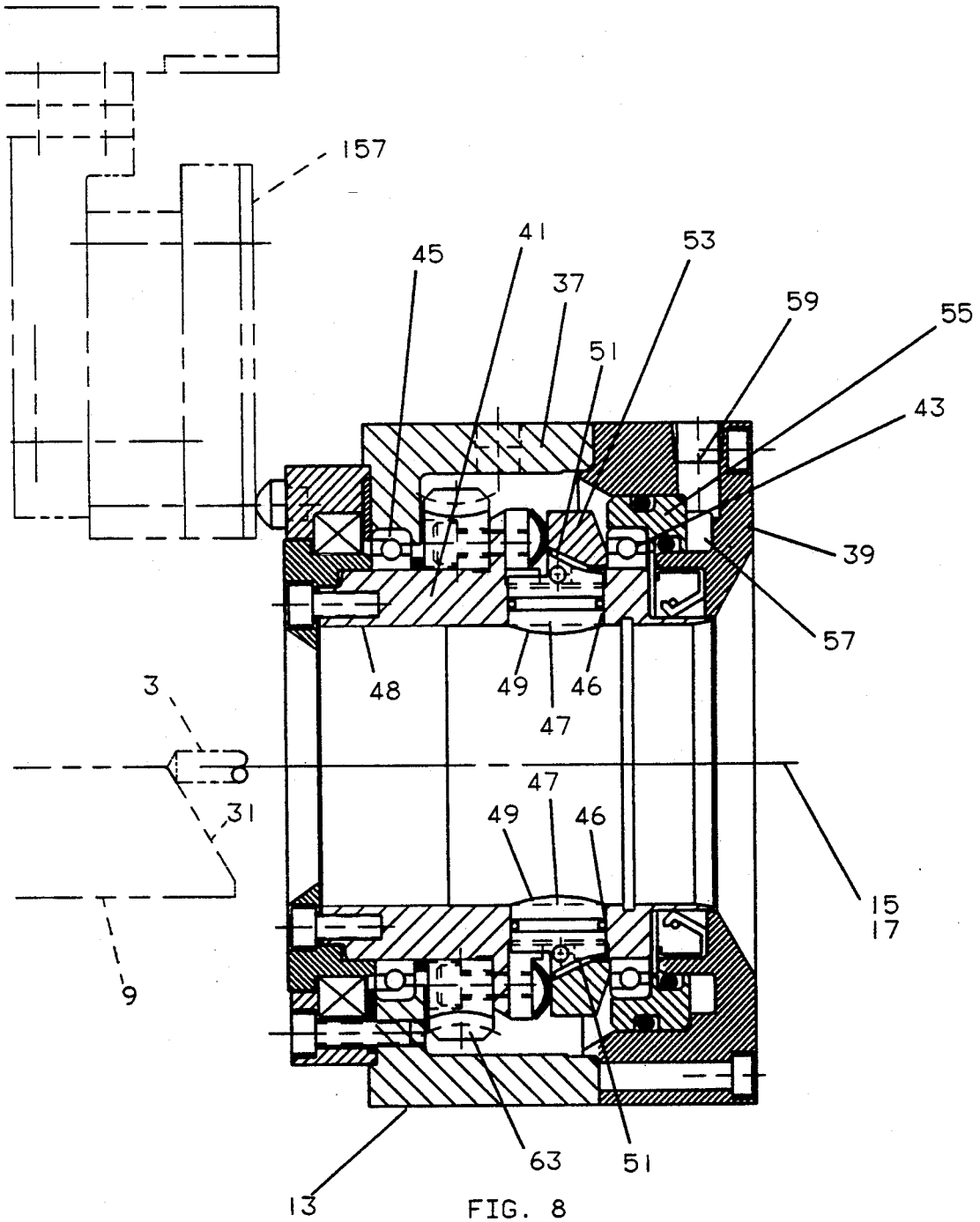
FIG. 8 is a cross sectional view taken along lines 8—8 of FIG. 4.

To rotate the spindle 41 and the drill 3 chucked therein, a worm wheel 63 is fastened to the spindle 41, FIGS. 4 and 8. The worm wheel 63 is driven by a worm 65 that is fixed to a shaft 67. The shaft 67 is mounted within the work head housing 37 for rotation about the lift axis 27. The shaft 67 is connected through a universal coupling 69 to the first end of a long shaft 71, FIG. 1. The second end of the shaft 71 is coupled by coupling 73 to the output shaft of the drill motor 75. The drill motor 75 is mounted to a bearing block 77. The drill motor 75 may be a servo motor, or it may be a variable speed AC motor that includes a resolver feed back. Rotation of the drill motor 75 causes a corresponding rotation of the spindle 41 and the drill 3. Thus, it is seen that the drill rotation mechanism 16 includes the spindle 41, worm 65 and worm wheel 63, drive shaft 71, drill motor 75, and bearing block 77.

DRILL LIFT

The bearing block 77 has a hole 79 therethrough that provides clearance for the coupling 73 and the drill motor output shaft. The bearing block also has a counterbore that receives bearings 81. Installed in the bearings 81 is the lower end of a long hollow post 83. The upper end of the post 83 is guided in the machine housing 5 by linear bearings 84. The shaft 71 passes through the interior of the post. The shaft 71, bearings 81, and post 83 are concentric with lift axis 27. To the upper end of the post 83 is joined the bracket 85. In the construction shown in FIG. 1, the upper end of the post 83 fits into a recess in the bracket base 87.

As a part of the drill point grinding process, the drill 3 and work head 13 reciprocate in the directions of arrow 21 in the lift motion. Lift reciprocation is achieved by means of the lift motor 23 acting through a gear reducer 100 and the drill lift mechanism 101. In the preferred embodiment, the drill lift mechanism comprises a shaft 103 that is coupled to the gear reducer 100 and that is rotatingly mounted by bearings 105 to the machine housing 5. The gear reducer 100 may have a 100:1 reduction. A similar shaft 107 is rotatingly mounted to the housing at a location generally vertically above the shaft 103. A pair of timing pulleys 109 and 111 are attached to the shaft 103, and a pair of similar pulleys 113, 115 are attached to the shaft 107. Timing belts 117 and 119 are trained around the pulleys 109, 113 and 111, 115, respectively.

To adjust the tension of the timing belts 117 and 119, the lift drive mechanism 101 further includes an idler pulley 121 in association with each belt. Each idler pulley 121 is mounted by a short arm 123 to a base 125. The bases 125 are fastened to the machine housing 5. The arms 123 are pivotable about the respective bases, as is indicated by arrow 127 in FIG. 3, to produce desired tension on the belts, and the arms are lockable at their desired locations to the respective bases.

Figure 5:
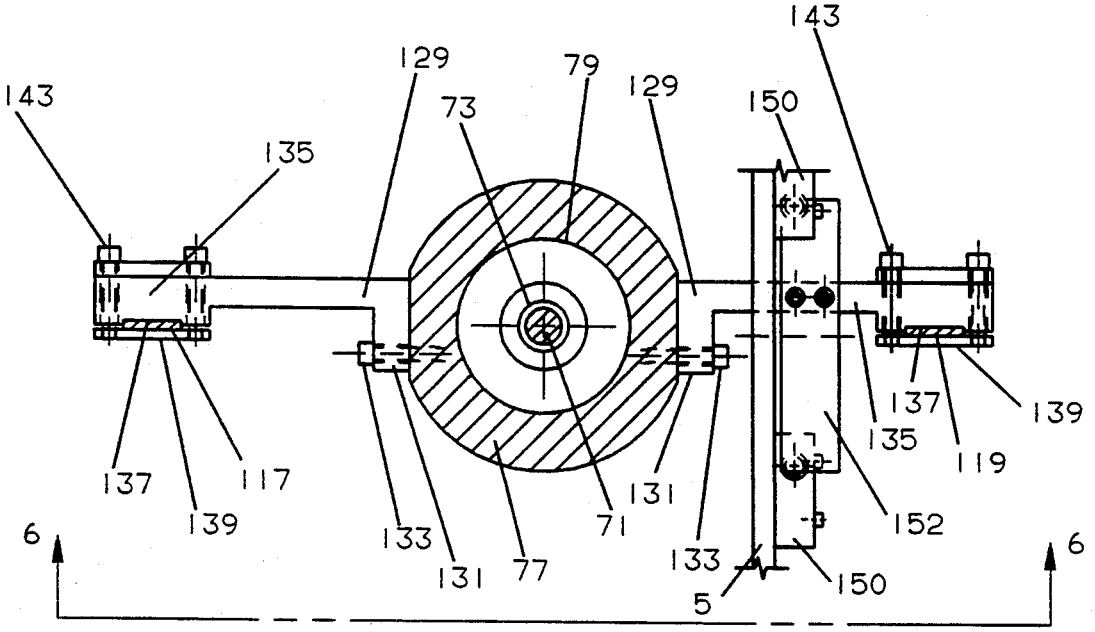
FIG. 5 is an enlarged partial cross sectional view taken along lines 5—5 of FIG. 1.
Figure 6:
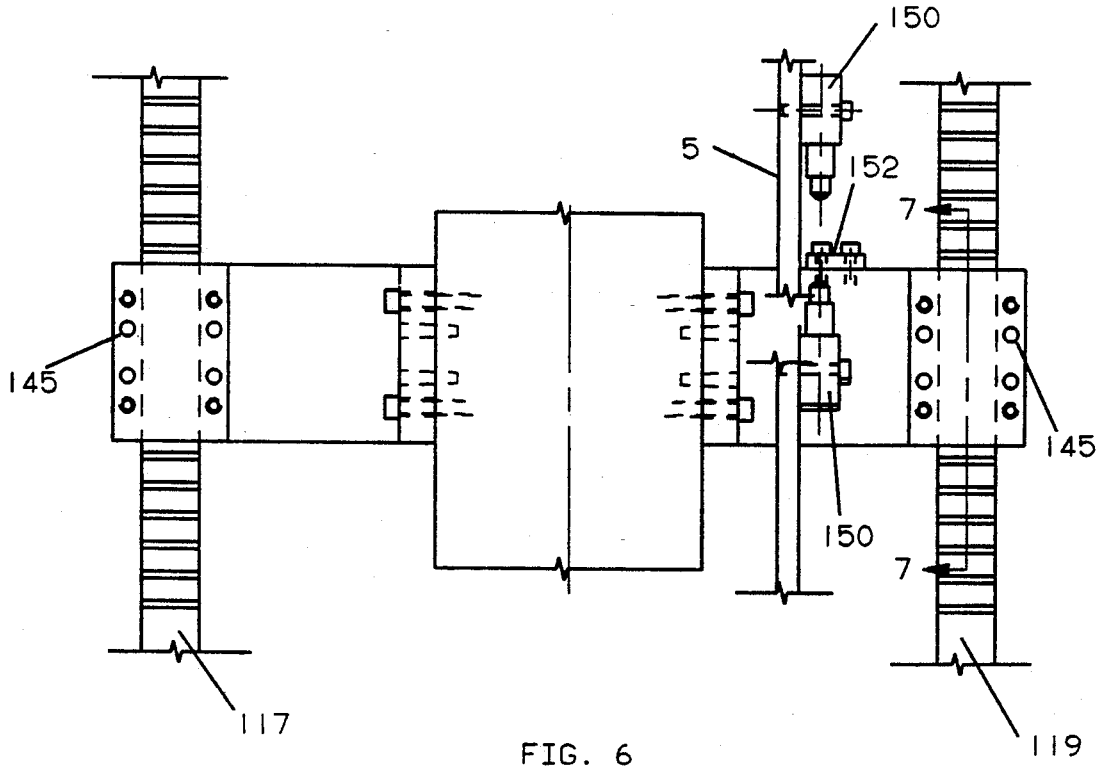
FIG. 6 is a view taken along lines 6—6 of FIG. 5.
Figure 7:
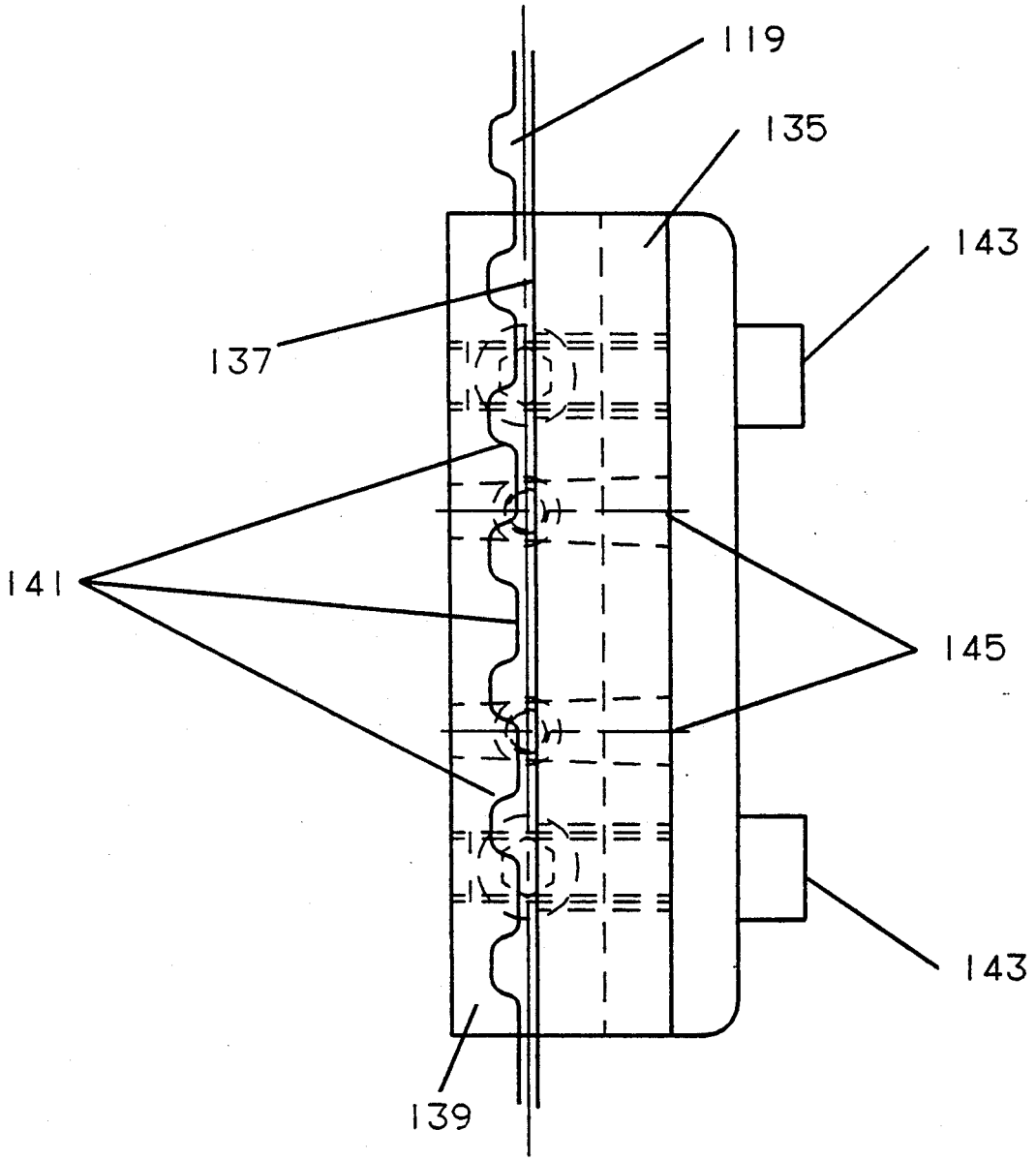
FIG. 7 is an enlarged cross sectional view taken along lines 7—7 of FIG. 6.

Referring also to FIGS. 5–7, the timing belts 117 and 119 are connected to the bearing block 77 by a pair of generally L-shaped brackets 129. One leg 131 of each bracket 129 is secured to the bearing block by screws 133. The free end of each bracket second leg 135 has a shallow recess 137 that is slightly wider than the width of a belt 117 or 119. A cap 139 has a series of teeth 141 that complement and mesh with the teeth of the timing belts. The back sides of the belts are placed in the respective bracket recesses 137, and the cap teeth 141 are placed in mesh with the timing belt teeth. Then the caps are fixed to the respective brackets by screws 143 and pins 145. In that manner, the bearing block is rigidly connected through the drive mechanism 101 to the lift motor 23.

The lift motor 23 is oscillated in timed relation with the rotation of the drill motor 75. Oscillation of the lift motor causes reciprocation of the timing belts 117 and 119 and thus corresponding reciprocation of the drill rotation mechanism 16, post 83, bracket 85, and work head 13. In FIGS. 1 and 3, the workhead 13 is shown at approximately the lowermost position of its reciprocating lift stroke.

To protect the grinding machine 1 against possible overtravel of the drill lift mechanism 101, safety limit switches 150 are installed on the housing 5. Also see FIGS. 5 and 6. The limit switches 150 are actuated by a trip 152 fastened to one of the lift mechanism brackets 129. If desired, a reference limit switch **150*a* may be employed. In addition, positive stops 154 are secured to the housing for stopping the bearing block 77 and the lift mechanism in case of failure of either limit switch 150. The positive stops 154 are strikable by a stop block 156 secured to the bearing block 77**.

DRILL FEED

In addition to rotation and lift, the drill 3 undergoes the feed motion indicated by arrow 25, FIG. 2. For that purpose, the present invention includes the drill feed mechanism 30, in which the feed motor 29 is mounted to the bearing block 77 by a suitable bracket 147. Also see FIGS. 9 and 10. Connected to the feed motor output shaft through a gear reducer 148 is a timing pulley 149. A 100:1 reduction is preferred for the gear reducer 148. A timing belt 151 is trained around the pulley 149 and also around another pulley 153 that is connected to the post 83. As mentioned previously, the lower end of the post 83 is rotatably mounted in the bearing block 77 by bearings 81, and the upper end of the post is guided within the machine housing 5 by bearings 84. See FIG. 1. Consequently, the post, and the bracket 85 joined thereto, can rotate about the lift axis 27 relative to the bearing block and the machine housing 5. By oscillating the feed motor 29, therefore, the post 83 and work head 13 oscillate correspondingly about lift axis 27. Such oscillation of the work head causes the drill 3 to be fed toward and withdrawn from the grinding wheel 9 in an arcuate path in the directions of arrow 25, FIG. 2.

Because the feed motor 29 is mounted to the bearing block 77, the feed motor reciprocates vertically in the directions of arrow 21 when the lift motor 23 oscillates. In addition, of course, the remainder of the feed mechanism 30 including the post 83, pulleys 149 and 153, and belt 151 undergo lift motion together with the drill rotation mechanism 16 when the lift motor is actuated. Conversely, actuation of the feed motor 29 has no effect on the drill rotation mechanism or on the feed mechanism 30.

In FIG. 2, the work head 13 is shown in the position of maximum clockwise oscillation about the lift axis 27. In that position, the drill axis 15 and the spindle axis 17 intersect the grinding wheel axis 11.

Figure 9:
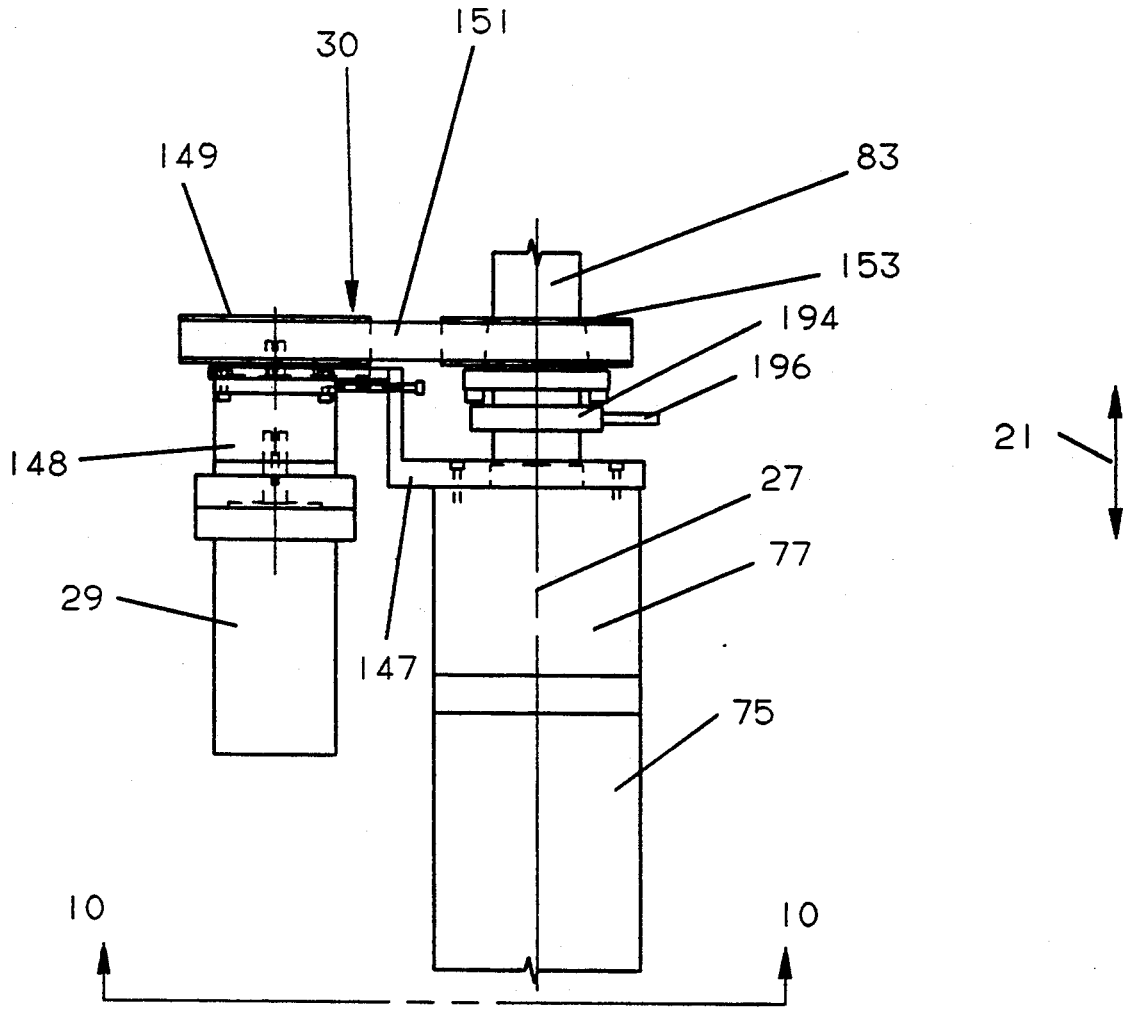
FIG. 9 is a partial view on a reduced scale taken along lines 9—9 of FIG. 2.
Figure 10:
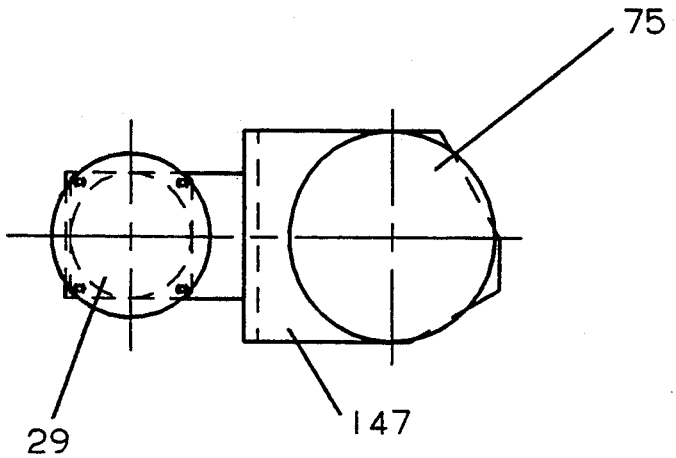
FIG. 10 is a view taken along lines 10—10 of FIG. 9.

Like the lift reciprocation, arrow 21, the drill feed oscillation is limited by limit switches and positive stops. The limit switches may be located as shown at reference numerals 176 in FIG. 1. A reference limit switch **176*a* is also shown. A Z-shaped plate 178 (FIG. 1) attached to the post 83 contacts the limit switches 176 to halt operation of the feed motor 29 if necessary. A collar 194, best illustrated in FIG. 9, is mounted to the post 83. A pin 196 pressed into the collar 194 is located so as to strike either of two positive stops 172 that are attached to the housing 5 angularly about the lift axis 27, FIG. 3**.

To minimize the force that the lift motor 23 must produce, the drill rotation mechanism 16, as well as the work head 13, and the feed mechanism 30 are counterbalanced. As best seen in FIG. 3, one or more springs 146 are connected between the housing 5 and the bearing block 77. The spring 146 is designed to bear almost the entire weight of the drill rotation mechanism and the feed mechanism, so that the lift motor need only overcome the inertia of those components during machine operation.

DRILL ROCK

As mentioned previously, the work head 13 is capable of tilting about the rock axis 35 relative to the bracket 85. If the particular drill point to be ground requires that the work head tilt about the rock axis, the stop plate 95 is swung about the screw 96 such that the plate does not contact bracket leg 89, FIG. 4. In that situation, the spring 97 forces the work head in a clockwise direction with respect to FIG. 3. Such clockwise rotation is controlled by the interaction between a hardened pin 155 carried by the work head and a hardened strip 157 secured to a portion of the machine housing 5. The pin 155 and strip 157 are designed such that the pin contacts the strip, under the urging of the spring 97, to maintain the drill axis 15 in a horizontal attitude when the drill axis intersects the grinding wheel axis 11, i.e., when the work head 13 is at the position of maximum clockwise oscillation about lift axis 27 as shown in FIG. 2. In FIG. 3, the work head is shown at the position of maximum clockwise rotation about the rock axis 35.

When the feed motor 29 is actuated to rotate the work head 13 and drill 3 counterclockwise about the lift axis 27 (arrow 25) from the position of FIGS. 2 and 3, the pin 155 and strip 157 prevent the portion 160 of the work head adjacent the pin from undergoing such rotation. Because of the bearings 93 between the work head housing 37 and the bracket 85, however, the post 83 and bracket 85 do undergo full rotation. The result is that the work head rotates counterclockwise with respect to FIG. 3 about the rock axis 35 such that the drill point tilts upwardly toward the grinding wheel axis 11. Maximum tilt occurs at the position of the maximum counterclockwise rotation of the feed oscillation about the lift axis 27 (FIG. 2).

The work head spring 97 continues to urge the work head pin 155 against the hardened strip 157 during the return clockwise rotation of the Work head feed oscillation 25. Consequently, the work head 13 tilts clockwise with respect to FIG. 3 during the feed clockwise rotation stroke about lift axis 27. Rock motion is thus inherently synchronized with the feed motion. At the end of the feed clockwise stroke, the spindle axis 15 is again horizontal, and it again (FIG. 2) intersects the grinding wheel axis 11.

When the rock motion is no longer needed, the plate 95 is swung back to the location shown in FIG. 1 against the leg 89 of the bracket 85, thereby locking out the rock motion.

To assure that the work head pin 155 does not strike the hardened strip 157 during a grinding operation when the rock motion 33 is not needed, the hardened strip is selectively removable from the proximity of the pin 155. In the particular construction illustrated in FIGS. 13 and 14, removal of the hardened strip is achieved by pivoting it about an axis 158 by means of a rotary actuator 162. The rotary actuator 162 is mounted to a bracket 164, which in turn is fastened to a plate 166. The plate 166 is joined to a base plate 168. One or more eccentric bushings 180 are releaseably fastened to an eject spacer 184 by respective cap screws 190. The eccentric bushings 180 bear against the edge 200 of the base plate 168, which is releaseably mounted to the eject spacer 184. By loosening the cap screws 190 and rotating the eccentric bushings 180, the base plate 168 can be adjusted in the directions of arrow 192, which is perpendicular to the work head axis 17 and the feed axis 27.

The eject spacer 184 is adjustably suspended from a block 193 by long threaded fasteners 195. Jam nuts 197 lock the eject spacer 184 at the desired location relative to the block 193 in the directions of arrow 198. The block 193 is supported by the machine housing 5.

To the output shaft of the rotary actuator 162 is fixed an L-shaped spacer 199. The hardened strip 157 is screwed to the spacer 199. The spacer 199 has a hub that is piloted in a bore in the bracket 164, and the hub is keyed to the rotary actuator output shaft. The rotary actuator 162 is operated through 90 degrees to rotate the hardened strip between an operative position indicated by the solid lines 157 in FIG. 13 and an inoperative position indicated by phantom lines 157'. In the operative position, the hardened strip is contactable by the work head pin 155 when the plate 95 is swung out of contact with the work head bracket leg 89, thus allowing rock motion 33 to occur. When the work head 13 is locked against rock motion by the plate 95 and the hardened strip is in the inoperative position 157', there is no possibility that the work head pin can strike the hardened strip during machine operation.

DRILL TIMING

To properly grind a point on a drill 3, it is imperative that the lift and feed motions 21 and 25, respectively, be synchronized with the drill rotation about its longitudinal axis 15. It is also necessary that the absolute rotational and longitudinal positions of the drill relative to the grinding wheel 9 be known. Correctly orienting the angular and longitudinal positions of the drill is called timing the drill.

To time the drill 3, the drill grinding machine 1 includes a hardened pad 159 secured to the bracket 164 that also mounts the rotary actuator 162. The pin 159 has a straight edge 170 that preferably is vertically oriented and that is contactable by a cutting edge of the drill.

Vertical orientation of the timing pad straight edge 170 is achieved by mounting the pad 159 in a shaft 201. The shaft 201 is received in a bore in the bracket 164. The shaft 201 grips the pad tightly, but the shaft is rotatable within the bracket for proper orientation of the straight edge 170 relative to the bracket. In addition, the shaft 201, together with the pad 159, is adjustable relative to the bracket 164 in the directions of arrow 203, which is parallel to the work head spindle axis 17. A set screw 205 locks the shaft and pad in the desired location within the bracket 164. The timing pad is thus adjustable relative to the housing 5 in three linear directions 192, 198, and 203, as well as being rotatable about the axis of the shaft 201.

Drill timing is achieved by actuating the lift motor 23 to lift the work head 13 along the lift axis 27 to a timing location, which is represented by spindle axis 17', FIG. 3. At the timing location, the spindle axis 17' is generally aligned with the timing pad 159 and is at a location higher than the highest location of the spindle axis during a drill grinding operation. With the work head at the timing location, pressure is removed from the work head port 59 (FIG. 8). A drill holder 18 or 86 (FIGS. 11 or 12), with a drill 3 gripped therein, is inserted into the spindle 41. The drill holder is manually pushed through the spindle and simultaneously rotated until one of the drill cutting edges contacts the straight edge 170 of the pad 159. When that occurs, the drill is properly located both rotationally and axially within the spindle. The drill holder is chucked by applying hydraulic pressure to the work head port 59 to operate the cams 47 against the sleeve 60. The drill is then ready to be ground.

GRINDING WHEEL

Material is removed from the drill 3 by the grinding wheel 9. Looking especially at FIG. 3, the grinding wheel is mounted to the spindle of a casing 161 which in turn is fixed to a slide 163. Also secured to the slide 163 is a motor 169. A conventional belt and pulley drive 171 may be used to connect the output shaft of the motor 169 to the casing spindle.

The slide 163 is movable horizontally in the directions of arrow 12 along rails 165 that form part of the machine housing 5. In the illustrated construction, slide movement is accomplished by the actuator 14, which may be a servo motor, acting through a screw 167. A nut, not shown, fixed to the slide cooperates with the screw 167 to convert rotary motion of the screw to linear motion of the slide, as is known in the art.

To compensate for wear of the grinding wheel periphery 31, the programmable controller or other control of the drill grinding machine 1 actuates the servo motor 14 to advance the slide 163 and grinding wheel 9 in incremental movements toward the lift axis 27. In that manner, proper material removal from the drill point is achieved. Also to compensate for wearing of the grinding wheel periphery, the drill grinding machine 1 may include a dressing tool, not shown. The dressing tool may be operated manually or under servo control to dress the grinding wheel periphery 31 as needed. Coolant may be supplied to the grinding wheel 9 by appropriate lines, as are known in the art, from a reservoir schematically depicted at reference numeral 174.

OPERATION

Figure 13:
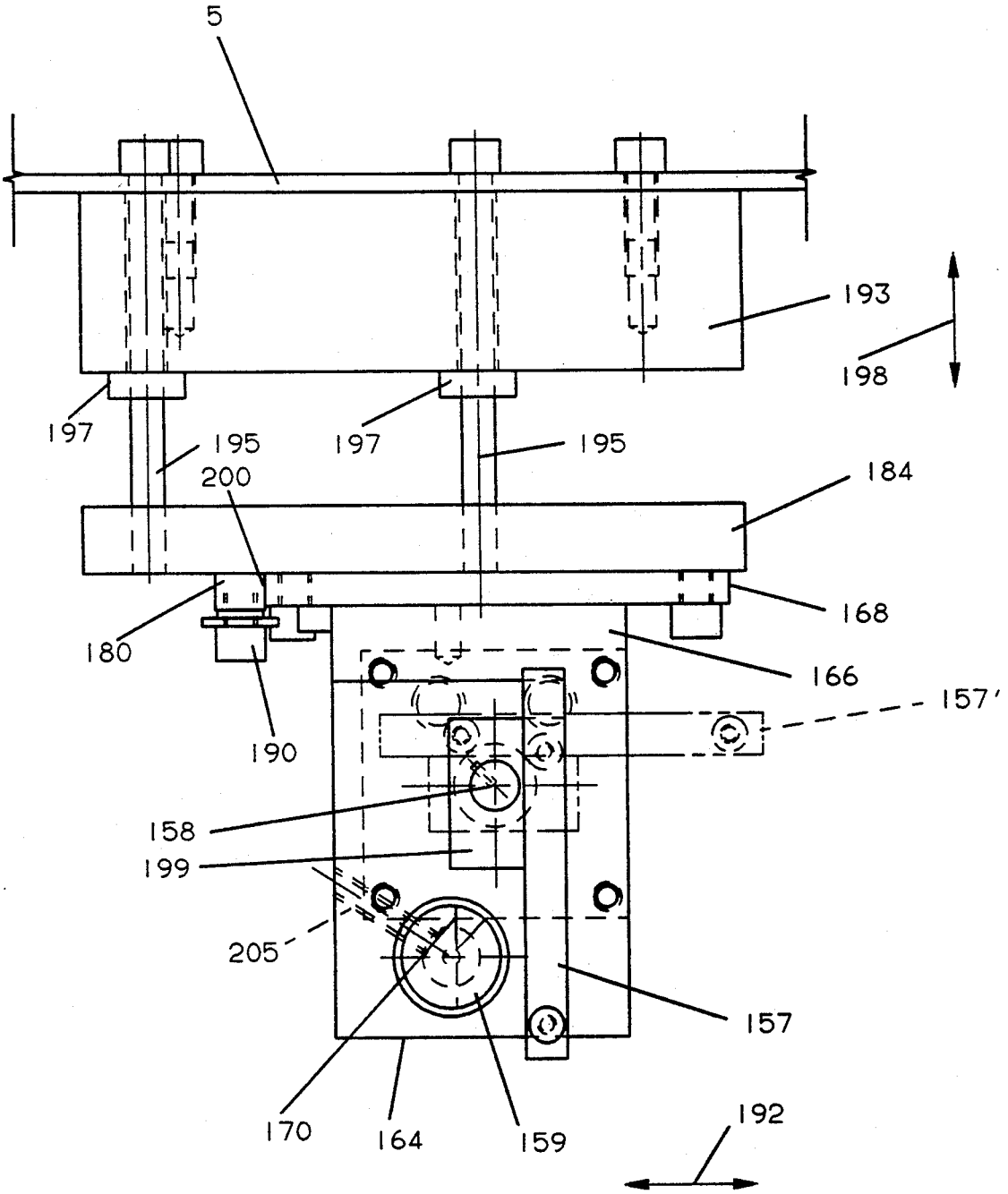
FIG. 13 is a front view of the rock strip assembly and drill timing device according to the present invention.
Figure 14:
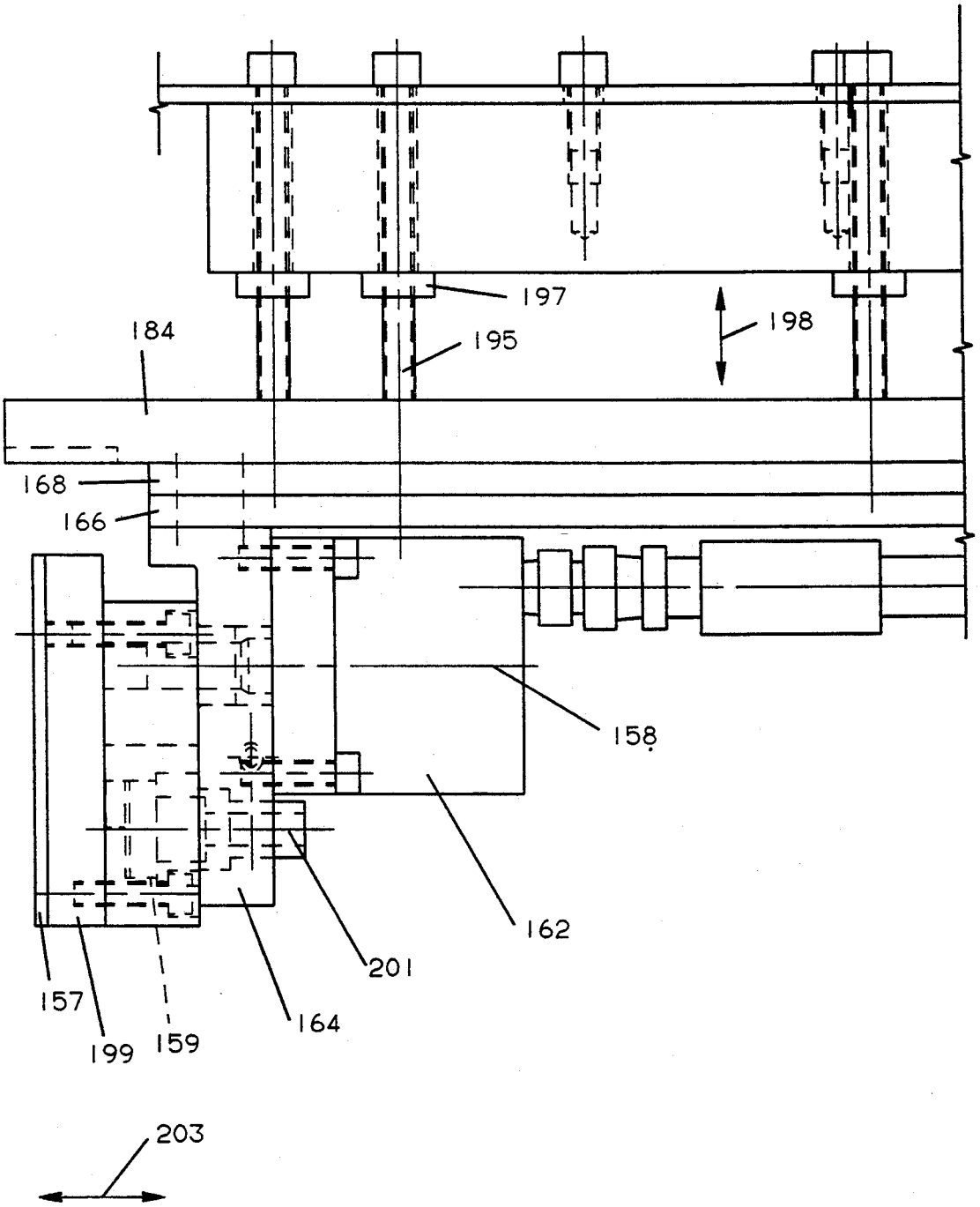
FIG. 14 is a side view of FIG. 13.

The drill grinding machine 1 can be operated to grind several types of drill points. With all types of points, the drill is first timed as previously described. Looking at FIGS. 15–21, the grinding of a Racon point will be described. A grinding wheel **9*a* having a tapered and generally concave periphery 31*a* is mounted to the spindle of the casing 161. When grinding Racon points, rock oscillation 33 is not required. Rock motion is therefore locked out by rotating stop plate 95 to contact arm 89 of the bracket 85. Rotary actuator 162 is actuated to rotate the hardened strip to the inoperative position 157' (FIGS. 13 and 14**).

Actuating the programmable controller or other control to a cycle mode starts the drill motor 75 to rotate, thereby rotating the drill **3*a* at a constant angular velocity in the direction of arrow 177. The lift motor 23 and feed motor 29 are also actuated to lift and feed the drill in directions 21 and 25, respectively, in timed correlation with the drill rotation 177. At the start of the cycle, the rotating drill 3*a* is out of contact with the grinding wheel 9*a*, and the drill axis 15*a* intersects the wheel periphery 31*a* proximate a face 179*a***.

Figure 15:
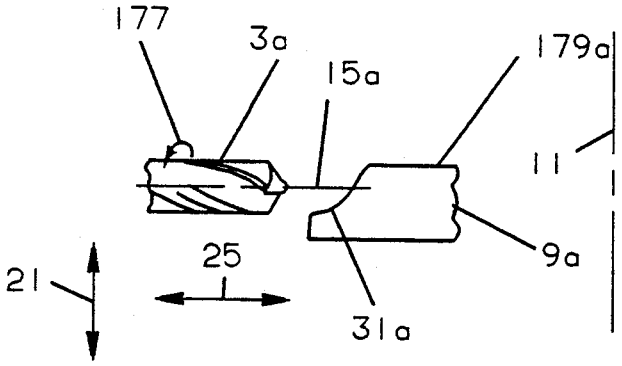
FIGS. 15-21 are fragmentary enlarged views of the relative positions of a drill and a grinding wheel during the grinding of a Racon point.
Figure 16:
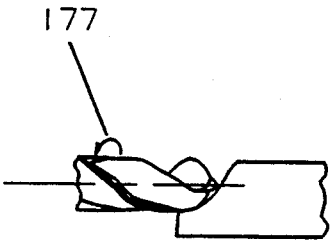
Figure 19:
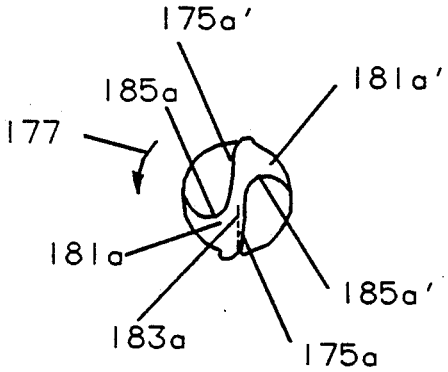
Figure 17:
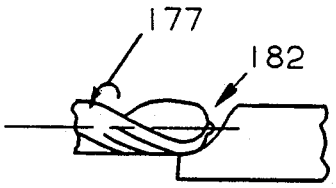
Figure 20:
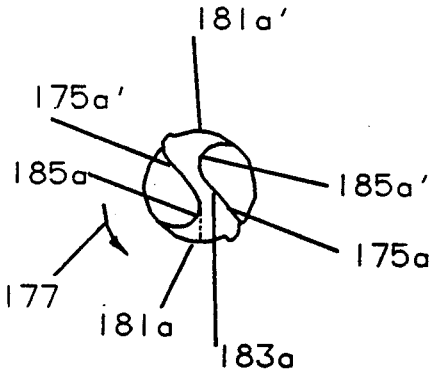
Figure 18:
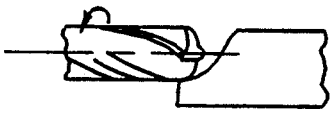
Figure 21:
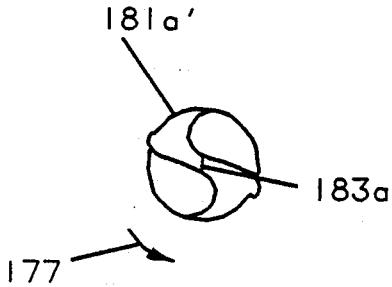
Figure 22:
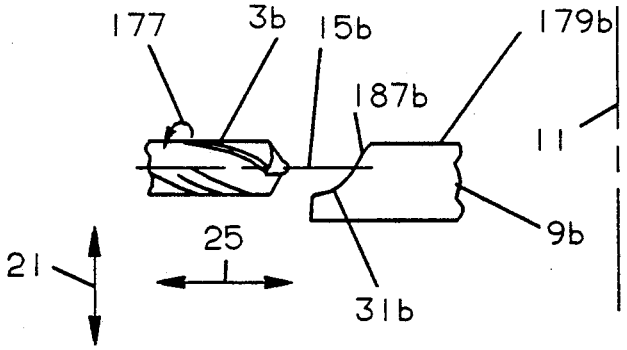
FIGS. 22-28 are fragmentary enlarged views of the relative positions of a drill and a grinding wheel during the grinding of a helical point.
Figure 23:
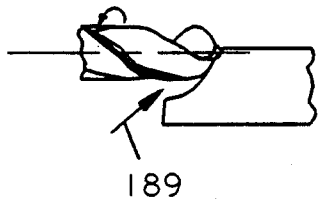
Figure 26:
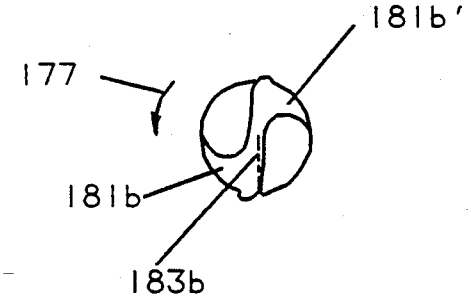
Figure 24:
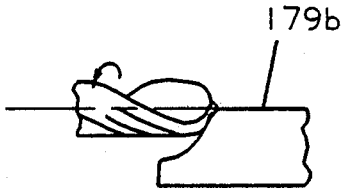
Figure 27:
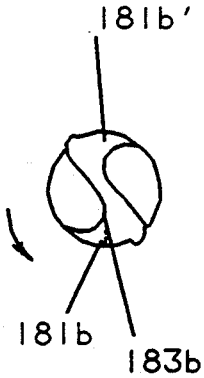
Figure 25:
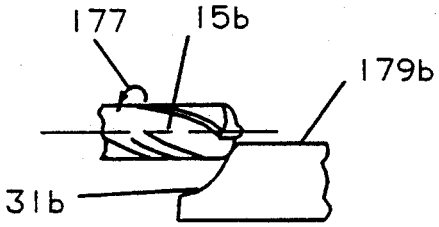
Figure 28:
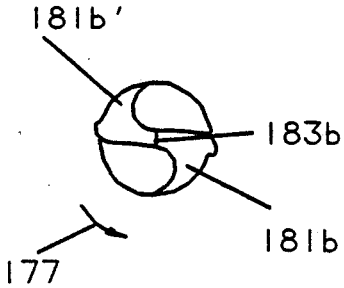
Figure 29:
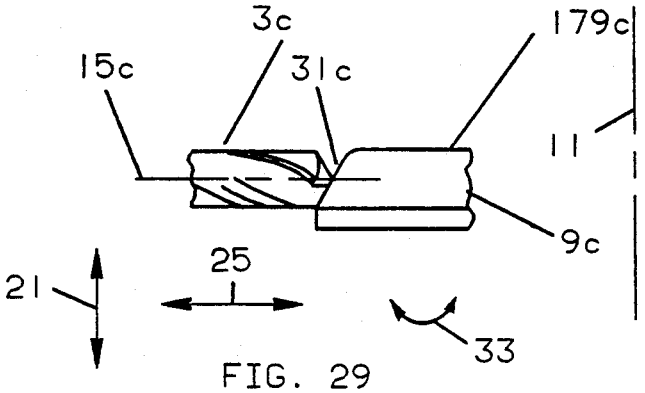
FIGS. 29-33 are fragmentary enlarged views of the relative positions of a drill and a grinding wheel during the grinding of a conventional point.

The distance between the drill point and the grinding wheel periphery **31*a* is exaggerated for clarity in FIG. 15. In actuality, the distance between the drill point and the grinding wheel 9*a* is such that the drill feed motion approaches a straight line. Feed motion causes the drill 3*a* to advance such that one of the drill lands 181*a* contacts the grinding wheel periphery 31*a* adjacent the drill cutting edge 175*a*; initial contact is along a line 183*a*. The programmable controller controls the lift and feed motions 21 and 25**, respectively, to cause drill axis 15*a* to move away from the grinding wheel face 179*a* and simultaneously to cause the drill to move away from the grinding wheel axis 11 in a controlled fashion to properly grind the land 181*a*. In that manner, the drill land slides along the concave grinding wheel periphery in the general direction of arrow 182.

During the grinding process, the drill cutting edge 175*a* moves steadily away from the line of contact 183*a* between the land 181*a* and the grinding wheel periphery 31*a*. At the same time, the trailing edge 185*a* of the land 181*a* moves toward the line of contact 183*a*. Finally, the drill axis 15*a* reaches the farthest location from the grinding wheel face 179*a*, and the drill is withdrawn from contact with the grinding wheel periphery, FIGS. 18 and 21. From that point, the drill 3*a* is repositioned to the beginning of its cycle, FIG. 15, and the cycle is repeated for the other land or lands 181*a*' of the drill. Thus, for a two-land drill such as drill 3*a*, two complete lift and feed cycles are performed for each revolution of the drill about its longitudinal axis 15*a*.

To assure that the desired amount of material is removed from the drill point during each drill revolution, the grinding wheel 9 is periodically advanced toward the lift axis 27. Such movement is controlled by the servo motor 14 under the control of the programmable controller.

FIGS. 22–28 show the path required for a drill 3*b* that is ground with a helical point. Rock motion is locked out during helical point grinding. Grinding wheel 9*b* has a concave periphery 31*b* and a face 179*b*. The face 179*b* blends into the periphery 31*b* at a smooth convex junction 187*b*. At the start of the grinding cycle, the drill axis 15*b* is parallel to the grinding wheel face 179*b* and intersects the grinding wheel periphery 31*b* in the vicinity of the junction 187*b*. As the drill 3*b* rotates in the direction of arrow 177, it advances under the feed motion 25 in timed relation to the drill rotation to contact the grinding wheel periphery 31*b*. The distance between the drill and the grinding wheel periphery is shown exaggerated in FIG. 22. Contact between the grinding wheel and the drill point is along line 183*b*. The combined lift and feed motions 21 and 25, respectively, continue to move the drill point toward the face 179*b* and toward the grinding wheel axis 11 in the general direction indicated by arrow 189. Drill lift and feed are in timed relation with the drill rotation 177. The cycle ends when the drill axis 15*b* is above the grinding wheel face 179*b*, FIG. 25. Then the drill is withdrawn from the grinding wheel 9*b* and lowered such that the drill axis 15*b* again intersects the grinding wheel periphery, FIG. 22, to start a new cycle. The cycle is repeated for each of the lands 181*b*, 181*b*' during a revolution of the drill.

Figure 30:
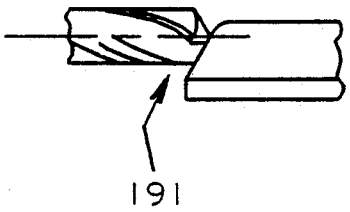
Figure 32:
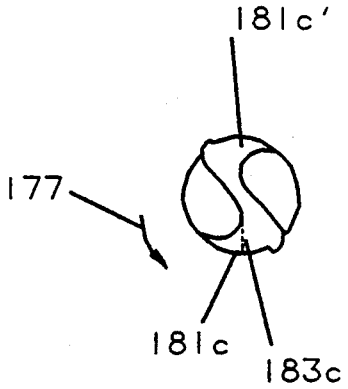
Figure 31:
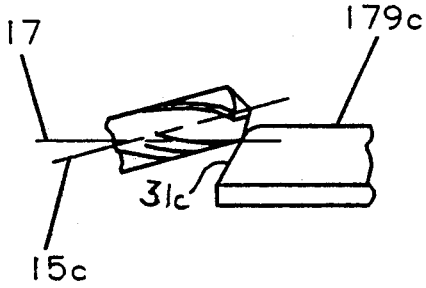
Figure 33:
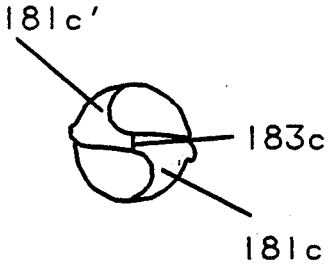

Grinding a conventional point on a drill 3*c* is illustrated in FIGS. 29–33. Conventional point grinding requires the rock motion 33. Therefore, the rotary actuator 162 is operated to rotate the hardened strip to the operative position 157 (FIGS. 13 and 14). The stop plate 95 is swung about screw 96 so as to be out of contact with the leg 89 of the bracket 85 (FIG. 1). A grinding wheel 9*c* is chosen that has a frusto-conical periphery 31*c*. After the drill 3*c* has been timed as previously described, the programmable controller actuates the lift and feed motors 23 and 29, respectively, to impart respective motions 21 and 25 to the drill. Simultaneously with the feed motion, the work head 13 and thus the drill 3*c* rock in the arcuate motion 33. At the beginning of the cycle, the drill axis 15*c* intersects the grinding wheel periphery 31*c* and is parallel to the grinding wheel face 179*c* and at a distance remote from it. For clarity, FIG. 30 shows a subsequent position of the drill relative to the grinding wheel assuming only feed and lift motions occur. In actuality, of course, in addition to the combined lift and feed motions indicated by arrow 191, the drill also undergoes rock motion 3 simultaneously with the feed motion 25; a representative location of the drill at the conclusion of the grinding portion of the cycle is shown in FIG. 31. At that point, the drill has undergone motion about all three axes 15*c*, 27, and 35. The line of contact between the grinding wheel periphery 31*c* and the drill point is shown at 183*c*. From the position of FIG. 31, the drill is returned to the position of FIG. 29 to complete a cycle. The cycle is repeated during each revolution of the drill for each of the lands 181*c* and 181*c*'.

Figure 34:
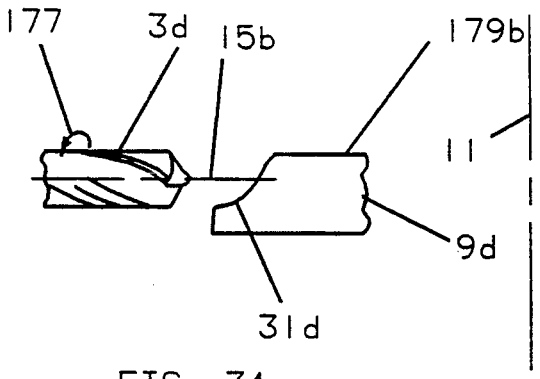
FIGS. 34-37 are fragmentary enlarged views of the relative positions of a drill and a grinding wheel during the grinding of a Bickford point.
Figure 35:
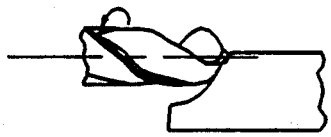
Figure 36:
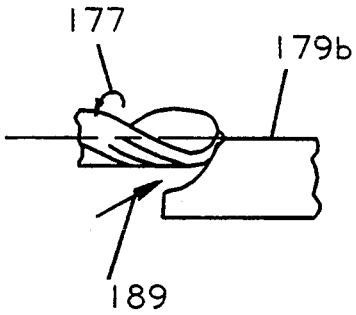
Figure 37:
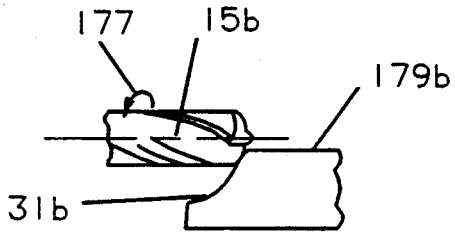

It is a feature of the present invention that the grinding machine 1 is capable of grinding combination drill points with a single set up and without altering any of the machine settings or controls. For example, a Bickford point, which combines the geometry of the helical and Racon points, can be ground with ease. To grind a Bickford point, the rock motion 33 is locked out, and the drill undergoes two independent cycles in succession. First, the drill is ground for a Racon point as was described previously in connection with FIGS. 15–21. Thus, the Bickford point cycle starts with the drill 3*d*, as shown in FIG. 34, together with grinding wheel 9*d*, at the start of the Racon grinding cycle. FIG. 35 shows the drill 3*d* at the conclusion of the grinding portion of the Racon cycle; the Racon cycle is repeated for the other lands on the drill 9*d* during one revolution of the drill. Upon completing the Racon grinding cycle, the programmable controller actuates the lift and feed motors 23 and 29, respectively, to position the drill to the proper location for starting a helical point grinding cycle, FIG. 36. After completing the grinding portion of the helical cycle, the drill is in the position of FIG. 37, after which the drill returns to the position of FIG. 36 for undergoing an additional grinding cycle for each of the remaining lands on the drill during each revolution thereof. At the completion of the full revolution of the drill and the corresponding helical point cycles, the drill returns to the position of FIG. 34. The grinding wheel 9*d* may be advanced incrementally toward the lift axis 27 by the servo motor 14, and the complete Racon-helical cycles are repeated until the Bickford point is properly ground.

Thus, it is apparent that there has been provided, in accordance with the invention, a drill grinding machine that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A method of sharpening a selected point on a twist drill comprising the steps of:

a. providing a housing with a grinding wheel having an axis of rotation;

b. providing a spindle having an axis perpendicular to the grinding wheel axis;

c. providing drill, lift, and feed motors;

d. clamping the drill inside the spindle with the drill and spindle axes being coincident and the drill point being proximate the grinding wheel;

e. actuating the drill motor to rotate the spindle and the drill about the drill axis;

f. simultaneously actuating the lift motor to reciprocate the spindle and the drill in directions perpendicular to the drill axis; and g. actuating the feed motor to oscillate the spindle and the drill about an axis parallel to the grinding wheel axis in timed relation with the lift and drill motors to move the drill point along a predetermined cyclical path of contact with the grinding wheel to grind the selected point.

2. The method of claim 1 comprising the further steps of:

a. providing a timing pad;

b. actuating the feed and lift motors to move the drill to a timing location whereat the drill point is proximate the timing pad;

c. releasing the drill in the spindle;

d. manually moving the drill within the spindle to contact the timing pad with the drill point to time the drill; and e. reclamping the drill inside the spindle prior to actuating the drill, lift, and feed motors.

3. The method of claim 1 wherein the step of actuating the lift and feed motors comprises the step of actuating the lift and feed motors to move the drill point along a first predetermined cyclical path of contact with the grinding wheel to grind a first selected point on a first portion of the drill and subsequently along a second predetermined cyclical path of contact with the grinding wheel to grind a second selected point on a second portion of the drill.

4. The method of claim 1 comprising the further steps of:

a. providing a work head that rotatably receives the spindle;

b. positioning a hardened strip within the housing from a first position remote from the work head to a second position proximate the work head prior to actuation of the lift and feed motors;

c. contacting the hardened strip with the work head while actuating the feed motor; and d. simultaneously tilting the work head about an axis perpendicular to the grinding wheel and drill axes in correlation, with the actuation of the feed motor.

5. The method of claim 4 comprising the further step of positioning the hardened strip within the housing from the second position to the first position subsequent to completion of a predetermined grinding cycle.

* * * * *